US008861999B2

(12) United States Patent
Ishida et al.

(10) Patent No.: US 8,861,999 B2
(45) Date of Patent: Oct. 14, 2014

(54) RECORDING-MATERIAL IDENTIFYING APPARATUS AND IMAGE FORMING APPARATUS

(75) Inventors: Tsutomu Ishida, Suntou-gun (JP); Shoichi Koyama, Susono (JP); Tomoharu Nakamura, Tokyo (JP); Shun-ichi Ebihara, Suntou-gun (JP); Norio Matsui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 359 days.

(21) Appl. No.: 13/272,101

(22) Filed: Oct. 12, 2011

(65) Prior Publication Data

US 2012/0106994 A1 May 3, 2012

(30) Foreign Application Priority Data

Oct. 28, 2010 (JP) ..... 2010-242461
Sep. 7, 2011 (JP) ..... 2011-194964

(51) Int. Cl.
*G03G 15/00* (2006.01)

(52) U.S. Cl.
CPC .. *G03G 15/5029* (2013.01); *G03G 2215/00751* (2013.01); *G03G 2215/00734* (2013.01); *G03G 2215/00738* (2013.01)
USPC ..... 399/45

(58) Field of Classification Search
CPC ..... G03G 15/5029; G03G 2215/00734; G03G 2215/00738; G03G 2215/00751
USPC ..... 399/45
See application file for complete search history.

(56) References Cited

U.S. PATENT DOCUMENTS 7,663,769 B2 * 2/2010 Hayashihara et al.
2009/0148176 A1 * 6/2009 Shida ..... 399/45

FOREIGN PATENT DOCUMENTS

JP 2002-111964 A 4/2002
JP 2002-182518 A 6/2002

* cited by examiner

*Primary Examiner* — Susan Lee
(74) *Attorney, Agent, or Firm* — Canon U.S.A., Inc. IP Division

(57) ABSTRACT

By providing a step in a pressing member for pressing a recording material P to a reading surface of an image-pickup unit, surface images in a tight contact area and a non-tight-contact area are picked up. By identifying the type of the recording material P based on the two surface images, the accuracy of identifying the recording material is improved without using a plurality of sensors.

14 Claims, 9 Drawing Sheets

IMAGE IN TIGHT CONTACT AREA

IMAGE IN NON-TIGHT CONTACT AREA

RECORDING-MATERIAL IDENTIFYING APPARATUS AND IMAGE FORMING APPARATUS

BACKGROUND OF THE INVENTION

1. Field of the Invention

The present invention relates to a recording-material identifying apparatus configured to pick up an image of the surface of a recording material to identify the surface properties thereof, and to an image forming apparatus configured to control image-forming conditions based on the identification result.

2. Description of the Related Art

In a conventional image forming apparatus, a user sets the type (size, etc.,) of a recording material through a computer, serving as an external apparatus, an operation panel provided on the body of the image forming apparatus, or the like. Transfer conditions (transfer voltage and conveyance speed of the recording material during transfer) at a transfer unit, fixing conditions (fixing temperature and conveyance speed of the recording materials during fixing), etc., are controlled based on the user's setting.

To spare users from such an inconvenience, namely, setting the type of the recording material through a computer or an operation panel, there has been provided an image forming apparatus having a sensor for identifying the type of a recording material to automatically identify the type of the recording material. Such an image forming apparatus having the sensor automatically identifies the type of a recording material and is controlled such that the transfer conditions, the fixing conditions, etc., are set based on the identification result.

More specifically, as disclosed in Japanese Patent Laid-Open No. 2002-182518, an image of the surface of a recording material is picked up using a complementary metal-oxide-semiconductor (CMOS), and the surface smoothness is detected from the picked-up image to identify the type of the recording material. Then, the image forming conditions are determined based on the identification result.

In such an apparatus that picks up an image of the surface of the recording material, a precise image of the surface of the recording material is picked up by making the distance between the recording material and the sensor constant. For example, Japanese Patent Laid-Open No. 2002-111964 proposes a configuration in which, while a recording material is pressed by a pressing member, a surface image of a part not pressed by the pressing member is read.

In some cases, the identification accuracy can be improved by reading a surface image of a part not pressed by the pressing member, as in the case of Japanese Patent Laid-Open No. 2002-111964 described in the related art section. However, depending on the type of the recording material, the identification accuracy can be improved by reading a surface image of a part pressed by the pressing member. Therefore, with a sensor having the structure disclosed in Japanese Patent Laid-Open No. 2002-111964, the identification accuracy is decreased in certain types of the recording material. Although it is possible to pick up a surface image of a part not pressed by the pressing member and a surface image of a part pressed by the pressing member using separate sensors, such a configuration leads to an increase in cost because it requires two sensors.

SUMMARY OF THE INVENTION

The present invention has been made in view of the above-described circumstances, and it can improve the accuracy of identifying the recording material with a low-cost sensor configuration.

The present invention provides a recording-material identifying apparatus including an illuminating unit configured to illuminate a recording material with light; a pressing member configured to press the recording material to form, in the recording material, a first pressing area and a second pressing area, a pressing force in the second pressing area being smaller than that in the first pressing area; an image-pickup unit configured to pick up images of light reflected by the recording material that is illuminated by the illuminating unit and is pressed by the pressing member as surface images of the recording material; and a control unit configured to identify the type of the recording material based on the surface images in the first pressing area and second pressing area that are picked up by the image-pickup unit.

Further features of the present invention will become apparent from the following description of exemplary embodiments with reference to the attached drawings.

DESCRIPTION OF THE EMBODIMENTS

Embodiments of the present invention will be described below with reference to the drawings. Note that the following embodiments do not limit the scope of the invention described in the claims, and not all the combinations of features described in the embodiments are needed to solve the problem.

First Embodiment

Figure 1:
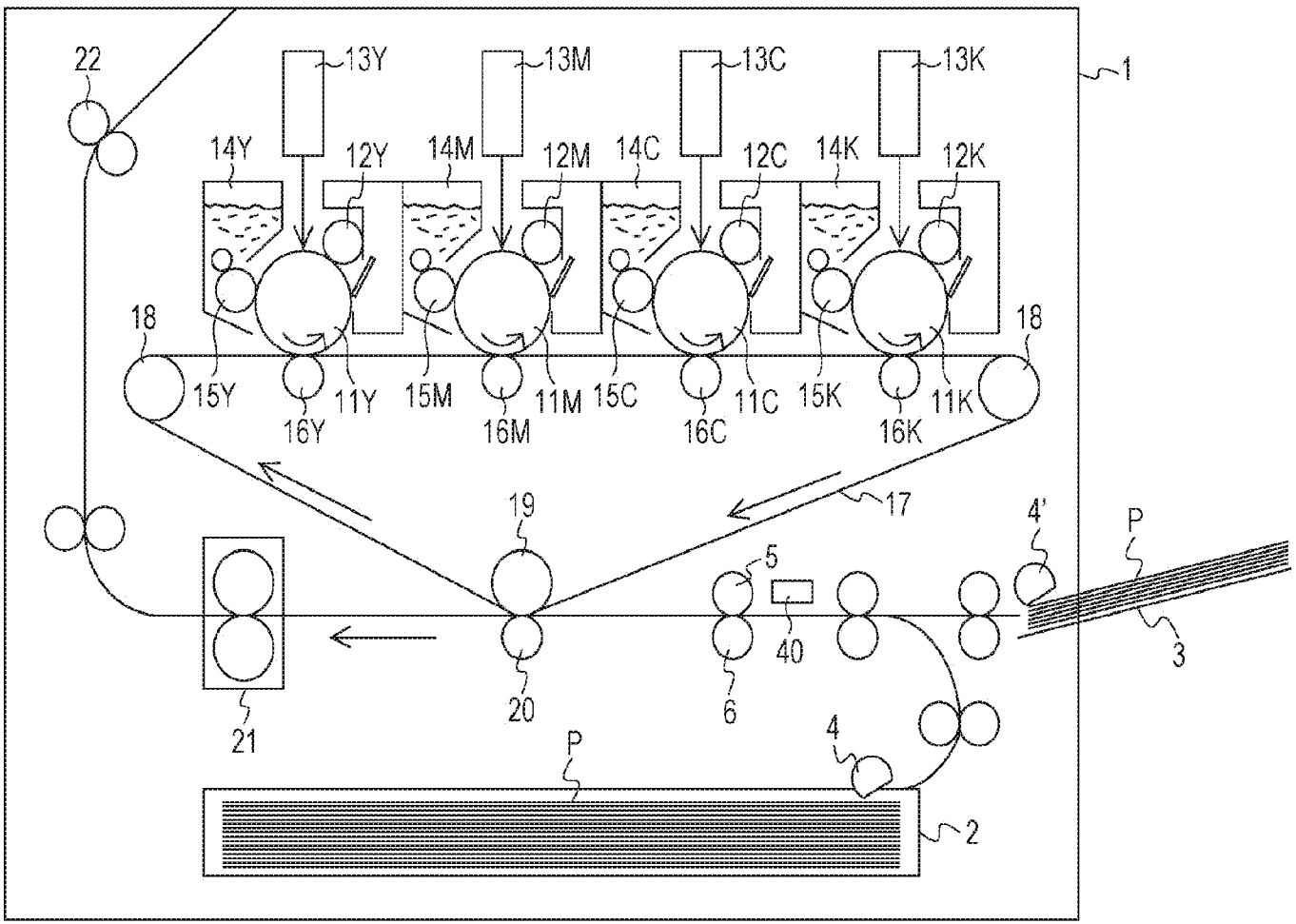
FIG. 1 shows the schematic configuration of an image forming apparatus.

A recording-material identifying apparatus according to this embodiment can be used in an image forming apparatus, such as a copier or a printer. FIG. 1 shows the configuration of an image forming apparatus having an intermediate transfer belt and a plurality of image forming portions arranged in parallel, which is an exemplary image forming apparatus having a recording-material identifying apparatus.

An image forming apparatus 1 shown in FIG. 1 has a sheet-feed cassette 2 that accommodates sheets serving as recording materials P; a sheet-feed tray 3 on which the recording materials P are placed; a sheet-feed roller 4 that feeds the recording material P in the sheet-feed cassette 2; a sheet-feed roller 4' that feeds the recording material P on the sheet-feed tray 3; a conveying roller 5 that conveys the recording materials P having been fed; a conveying opposing roller 6 that faces the conveying roller 5; photoconductive drums 11Y, 11M, 11C, and 11K that respectively carry yellow, magenta, cyan, and black toners; charging rollers 12Y, 12M, 12C, and 12K, serving as primary charging units for the respective colors, that uniformly charge the photoconductive drums 11Y, 11M, 11C, and 11K at a predetermined potential; and optical units 13Y, 13M, 13C, and 13K that emit laser beams according to image data of the respective colors to the photoconductive drums 11Y, 11M, 11C, and 11K charged by the primary charging units to form electrostatic latent images thereon.

The image forming apparatus 1 further includes developing units 14Y, 14M, 14C, and 14K that make the electrostatic latent images formed on the photoconductive drums 11Y, 11M, 11C, and 11K visible; toner conveying rollers 15Y, 15M, 15C, and 15K that supply toner in the developing units 14Y, 14M, 14C, and 14K to the portions facing the photoconductive drums 11Y, 11M, 11C, and 11K; primary transfer rollers 16Y, 16M, 16C, and 16K for the respective colors that primarily transfer the images formed on the photoconductive drums 11Y, 11M, 11C, and 11K; an intermediate transfer belt 17 that carries the primarily transferred images; driving rollers 18 that drive the intermediate transfer belt 17; a secondary transfer roller 19 that transfers the image formed on the intermediate transfer belt 17 to the recording material P; a secondary-transfer opposing roller 20 that faces the secondary transfer roller 19; a fixing unit 21 that fusion-fixes the toner image transferred to the recording material P while conveying the recording material P; and a discharge roller 22 that discharges the recording material P having gone through the fixing process in the fixing unit 21.

The photoconductive drums 11Y, 11M, 11C, and 11K, the charging rollers 12Y, 12M, 12C, and 12K, the developing units 14Y, 14M, 14C, and 14K, and the toner conveying rollers 15Y, 15M, 15C, and 15K for each color are integrated as a single unit. The unit including the photoconductive drum, the charging roller, and the developing unit is called a cartridge. The cartridges for the respective colors can be easily attached to and detached from the image forming apparatus 1.

Next, an image-forming operation of the image forming apparatus 1 will be described. Print data containing a print instruction and image information are input from a host computer or the like (not shown) to the image forming apparatus 1. The image forming apparatus 1 then starts a printing operation, and a recording material P is fed from the sheet-feed cassette 2 or the sheet-feed tray 3 by the sheet-feed roller 4 or the sheet-feed roller 4' into a conveyance path. The recording material P stops at the conveying roller 5 and the conveying opposing roller 6 and waits until an image is formed, so that an image-forming operation, in which an image is formed on the intermediate transfer belt 17, and the conveyance of the recording material P are synchronized. At the same time when the recording material P is fed, the charging rollers 12Y, 12M, 12C, and 12K charge the photoconductive drums 11Y, 11M, 11C, and 11K at a certain potential (image-forming operation). The optical units 13Y, 13M, 13C, and 13K scan the laser beam across the surfaces of the charged photoconductive drums 11Y, 11M, 11C, and 11K according to the input print data, thereby forming electrostatic latent images thereon. The developing units 14Y, 14M, 14C, and 14K and the toner conveying rollers 15Y, 15M, 15C, and 15K develop the electrostatic latent images formed on the photoconductive drums 11Y, 11M, 11C, and 11K to make them visible. The electrostatic latent images formed on the surfaces of the photoconductive drums 11Y, 11M, 11C, and 11K are developed as color images by the developing units 14Y, 14M, 14C, and 14K. The photoconductive drums 11Y, 11M, 11C, and 11K are in contact with the intermediate transfer belt 17 and, thus, are rotated in synchronization with the rotation of the intermediate transfer belt 17. The developed images are sequentially transferred to the intermediate transfer belt 17 in an overlapping manner by the primary transfer rollers 16Y, 16M, 16C, and 16K. The images are then transferred to the recording material P by the secondary transfer roller 19 and the secondary-transfer opposing roller 20.

Then, in synchronization with the image-forming operation, the recording material P is conveyed to a secondary transfer section to be subjected to the secondary transfer. The image formed on the intermediate transfer belt 17 is transferred to the recording material P by the secondary transfer roller 19 and the secondary-transfer opposing roller 20. The toner image transferred to the recording material P is fixed by the fixing unit 21 that includes the fixing roller etc. The recording material P after the fixing process is discharged by the discharge roller 22 onto a paper output tray (not shown). Thus, the image-forming operation is completed.

In the image forming apparatus in FIG. 1, a recording-material identifying apparatus 40 of the present invention is disposed on the upstream side of the conveying roller 5 and the conveying opposing roller 6 and can detect the information about the surface smoothness of the recording material P conveyed from the sheet-feed cassette 2 or the like. In this embodiment, the recording material P is identified by the recording-material identifying apparatus 40 during conveyance after it is fed from the sheet-feed cassette 2 into the image forming apparatus and before it is nipped between the conveying roller 5 and the conveying opposing roller 6, or during conveyance while it is nipped between the conveying roller 5 and the conveying opposing roller 6. This is because the recording-material identifying apparatus 40 of the present invention employs a line sensor. In a conventional identifying apparatus, because a recording material P is stopped and an image thereof is picked up with an area sensor, the image-pickup area is preliminarily designated. In the recording-material identifying apparatus 40 according to this embodiment, an image of a recording material P is picked up with a line sensor during conveyance. Therefore, the surface image needed to identify the recording material P can be picked up while appropriately changing the area thereof.

Figure 2A:
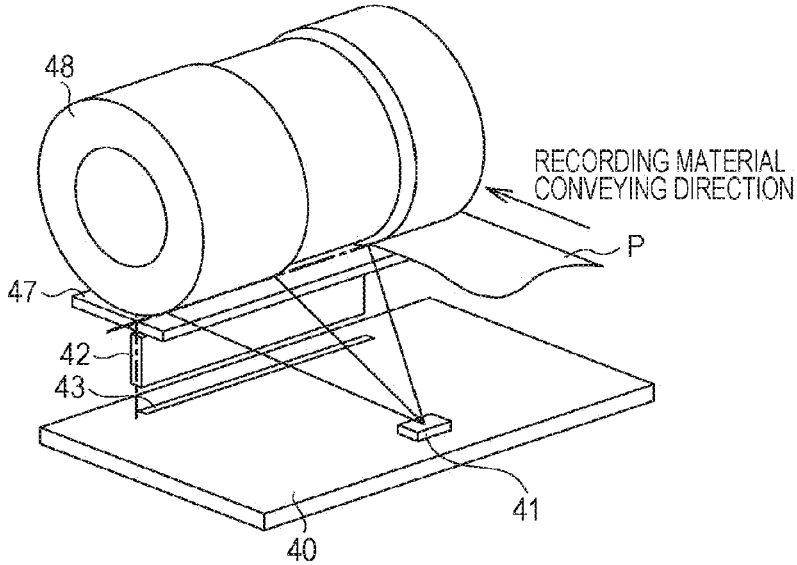
FIGS. 2A to 2C are a perspective view, a vertical cross-sectional view, and a horizontal cross-sectional view showing the configuration of a recording-material identifying apparatus according to a first embodiment.
Figure 2B:
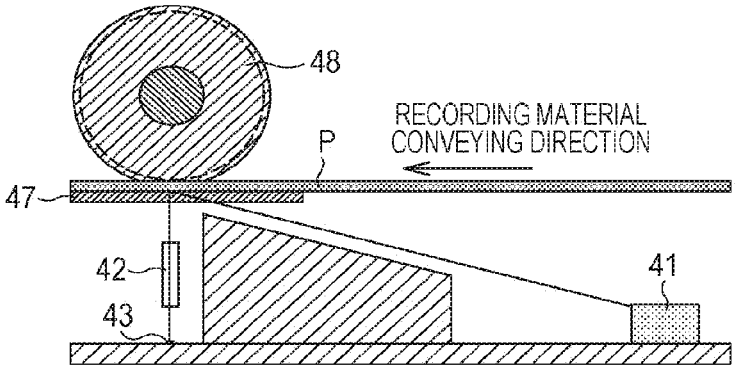
Figure 2C:
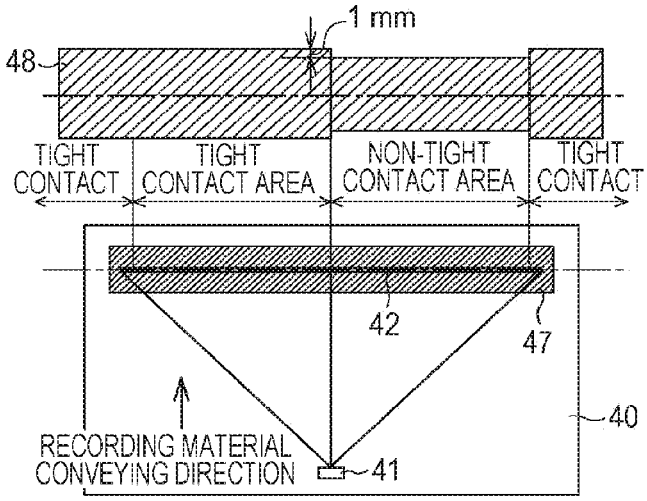

Next, referring to FIGS. 2A to 2C, the recording-material identifying apparatus 40 according to this embodiment will be described. FIG. 2A shows the configuration of the recording-material identifying apparatus 40 configured to pick up a surface image representing the surface smoothness. FIG. 2B is a vertical cross-sectional view of FIG. 2A, and FIG. 2C is a horizontal cross-sectional view of FIG. 2A.

The recording-material identifying apparatus 40 shown in FIG. 2A includes an illuminating light-emitting diode (LED) 41, serving as an illuminating unit, which illuminates the surface of a recording material P with light; an image-forming lens 42, serving as an image-forming unit, which receives reflected light, i.e., light emitted from the illuminating unit and reflected by the surface of the recording material P, and forms an image; and a CMOS line sensor 43, serving as an image-pickup unit, which picks up images of the light formed by the image-forming unit. Light emitted from the LED 41 is incident on the recording material P and is reflected by a reflective portion, and images of the light reflected by the reflective portion, i.e., surface images, are picked up by the CMOS line sensor 43. A protection member 47 protects the image-forming lens 42 and the illuminating LED 41. A pressing member 48 facing the protection member 47 forms a nip portion with respect to the protection member 47, and presses the recording material P being conveyed.

Furthermore, the conveying roller 5 and the conveying opposing roller 6 that convey the recording material P, and a conveyance guide (not shown) that forms a conveyance path for the recording material P, are provided as a mechanism for conveying the recording material P. Although the illuminating LED 41 used in this embodiment is a white-color LED, the illuminating LED 41 is not limited to a white-color LED, as long as it can illuminate the recording material P.

Note that the pressing member 48 does not necessarily have to press the recording material P at both tight contact area and non-tight-contact area. For example, the tight contact area may serve as a pressing area where the recording material P is pressed, and the non-tight-contact area, in which the diameter of the pressing member 48 is small, may serve as a non-pressing area where the recording material P is not pressed.

As shown in FIG. 2B, the image-forming lens 42 and the CMOS line sensor 43 are disposed perpendicular to a conveying direction of the recording material P, and the image-forming lens 42 forms images of the light emitted from the illuminating LED 41, the intensity thereof being controlled by an illumination control section 102, and reflected by the surface of the recording material P. The images of the reflected light formed by the image-forming lens 42 are picked up by the CMOS line sensor 43. The pressing member 48 presses a reading position of the CMOS line sensor 43. In this embodiment, the illuminating LED 41 illuminates the surface of the recording material P with light at an angle of 10 degrees. Note that, however, this is just an exemplary angle, and it is not limited to 10 degrees, as long as images sufficient for identifying the recording material P can be picked up. Although the CMOS line sensor 43 is used as the image-pickup unit, the image-pickup unit is not limited thereto, and a two-dimensional area sensor or the like may be used.

FIG. 2C shows the ideal mounting position of the illuminating LED 41, in which the optical axis of the illuminating LED 41 is orthogonal to the middle portion of the CMOS line sensor 43. Note that, however, taking into consideration the mounting precision of the illuminating LED 41, the optical axis does not need to be orthogonal to the middle portion of the CMOS line sensor 43. Furthermore, the pressing member 48 has an illuminating area to the left of the optical axis of the illuminating LED 41, which serves as a tight contact area, with which the recording material P is brought into tight contact, and an illuminating area to the right of the optical axis of the illuminating LED 41, which serves as a non-tight-contact area, with which the recording material P is not brought into tight contact. In this embodiment, the tight contact area and the non-tight-contact area are formed by creating a nip between the pressing member and the protection member. However, a configuration in which pressing forces are differentiated is also possible, in which, for example, the tight contact area, i.e., the illuminating area on the left side, serves as a pressing area where the pressing force is large, and the non-tight-contact area, i.e., the illuminating area on the right side, serves as a pressing area where the pressing force is smaller than that in the tight contact area. In the pressing member 48 according to this embodiment, the diameter of the part facing the non-tight-contact area is smaller than that of the part facing the tight contact area by 1 mm. However, as long as the tight contact area and the non-tight-contact area can be formed, the configuration is not limited thereto. Furthermore, as long as the tight contact area and the non-tight-contact area can be formed, the right side and left side of the pressing member 48 can be changed. Furthermore, the number of tight contact areas and the number of non-tight-contact areas are not limited to one each, and the tight contact areas and the non-tight-contact areas may be formed alternately.

Figure 3:
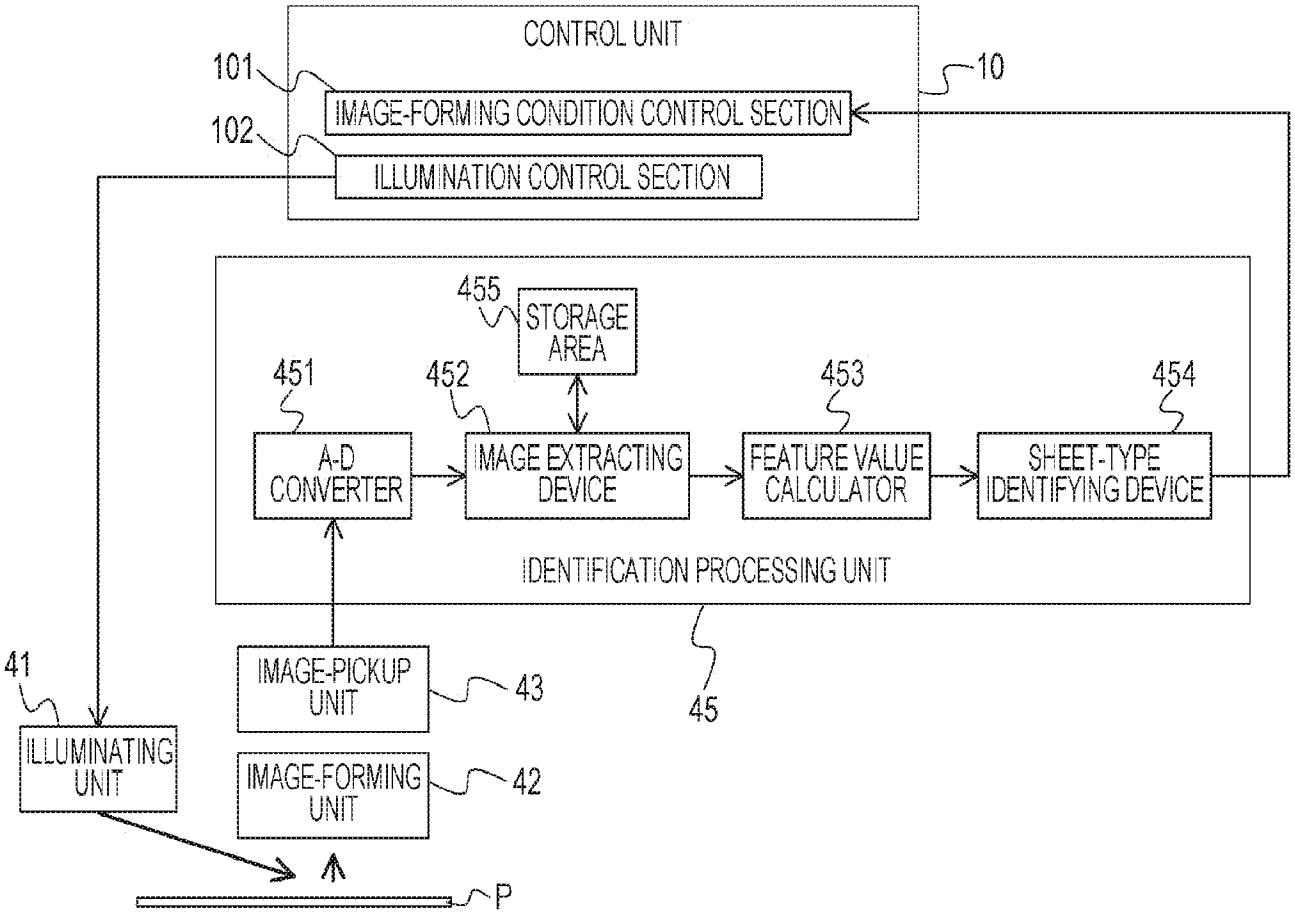
FIG. 3 is a block diagram showing the operation control of the recording-material identifying apparatus.

FIG. 3 is an exemplary block diagram showing the operation control of the recording-material identifying apparatus 40. The illuminating LED 41 illuminates the surface of the recording material P, while being conveyed, with light. The image-forming lens 42 forms images of the light reflected by the recording material P, and the CMOS line sensor 43 picks up the surface images. The surface images of the recording material P picked up by the CMOS line sensor 43 are output to an identification processing unit 45.

In the identification processing unit 45, the received surface images of the recording material P are subjected to AD conversion in an A-D converter 451. Thus, images on the same straight line perpendicular to the conveying direction of the recording material P are obtained. In this embodiment, an 8-bit A-D conversion IC is used, and the A-D converter 451 outputs a value in the range from 0 to 255. An image extracting device 452 and a storage area 455 connect the received surface images of the recording material P in the conveying direction to form a two-dimensional surface image. In this embodiment, the recording material P is conveyed at a speed of 80 mm/s, and the CMOS line sensor 43 has a resolution of 600 dpi per line (about 42 μm per dot). Therefore, the image size is 236 dots×118 dots, and an image of an area having a size of about 10 mm×5 mm of the recording material P can be picked up. The CMOS line sensor 43 picks up an image at 42 μm/(80 mm/s), at an interval of about 530 μs or more. This prevents the image-pickup areas of the recording material P from overlapping.

From the thus-obtained two-dimensional surface images, a surface image used to identify the type of the recording material P is extracted according to the information about the optical axis and effective image area stored in the storage area 455. At this time, to identify the type of the recording material P, the shading of the surface image is corrected. In a feature value calculator 453, the feature value is calculated from the extracted surface image. Based on the result calculated by the feature value calculator 453, a sheet-type identifying device 454 identifies the sheet type. The result obtained by the sheet-type identifying device 454 is output to an image-forming condition control section 101 of a control unit 10, which controls the image-forming conditions based on the result. The image-forming conditions include the transfer voltage, the conveyance speed of the recording material P, the temperature of the fixing unit, etc. For example, when, as a result of the sheet-type identification, the recording material P is determined to be bond paper, whose fixing characteristics are not good compared with plain paper, control, such as slowing down the conveyance speed of the recording material P to increase the fixing time in the fixing unit 21, increasing the fixing temperature, or the like is performed. The storage area 455 stores the current value for controlling emission of the LED 41, the light-intensity target value needed to adjust the light intensity (described below), and dark current data when the LED 41 is OFF and light-intensity variation data when the LED 41 is ON, which are used to correct light intensity variation (described below).

Figure 4A:
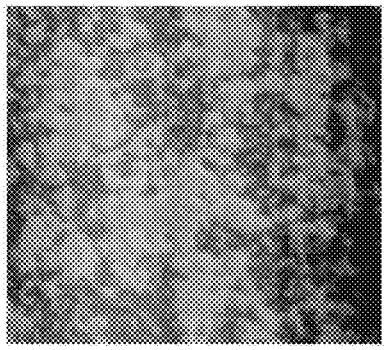
FIGS. 4A and 4B are a surface image in a tight contact area and a surface image in a non-tight-contact area of a recording material.
Figure 4B:
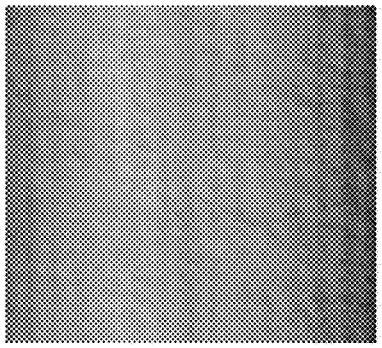

FIGS. 4A and 4B show images picked up from the recording material P in this embodiment, which will be described below. First, as described above, the recording material P is conveyed, and surface images thereof are picked up by the image-pickup unit. The surface images picked up in the tight contact area and the non-tight-contact area, shown in FIG.

2C, are extracted. FIGS. 4A and 4B show the surface images picked up with coated paper (available under the trade name "HP Laser Photo Paper, glossy"). FIGS. 4A and 4B show the surface images picked up with coated paper, in the tight contact area and the non-tight-contact area, respectively.

In the tight contact area, because fluttering of the recording material P during conveyance can be significantly reduced, variation of the focal point of the image-pickup unit is reduced. Thus, an accurate surface image can be picked up. As a result, the difference in surface smoothness can be further accentuated, and a stable output value can be obtained. Thus, the identification accuracy is improved. However, recording materials P like coated paper, which have relatively flat surface properties compared with plain paper, may adhere to the reading surface of the image-pickup unit. This causes the light emitted to the recording material P, at a part adhered to the reading surface, to be specularly reflected, and hence, the light is not reflected to the image-pickup unit. As a result, the surface image picked up from this part is darker than the actual brightness of the surface of coated paper. That is, with the surface image picked up in the tight contact area, the identification accuracy of recording materials P like plain paper, whose surface properties are not relatively smooth, can be improved, whereas the identification accuracy of recording materials P like coated paper, whose surface properties are relatively smooth and smooth, is difficult to improve.

On the other hand, in the non-tight-contact area, if fluttering of the recording material P during conveyance occurs, the picked up surface image may be blurred. The output value of a blurred surface image may be lower than that of the surface image picked up in the tight contact area. However, with recording materials P like coated paper, whose surface properties are relatively smooth, even if fluttering of the recording material P during conveyance occurs, it is possible to pick up a surface image that is more precise than a surface image picked up when the recording material P adheres to the image-pickup surface in the tight contact area. That is, the surface image picked up in the non-tight-contact area may be affected by conveyance fluttering when recording materials P like plain paper, whose surface properties are not relatively smooth, are used, and the identification accuracy may be decreased compared with the surface image picked up in the tight contact area. However, in the case of recording materials P like coated paper, whose surface properties are relatively smooth, even if they are affected by conveyance fluttering, the identification accuracy is improved compared with the surface image picked up in the tight contact area.

A method of improving the accuracy of identifying the recording material P by combining the merits of the surface image in the tight contact area and the surface image in the non-tight-contact area will be described in detail below.

Figure 5:
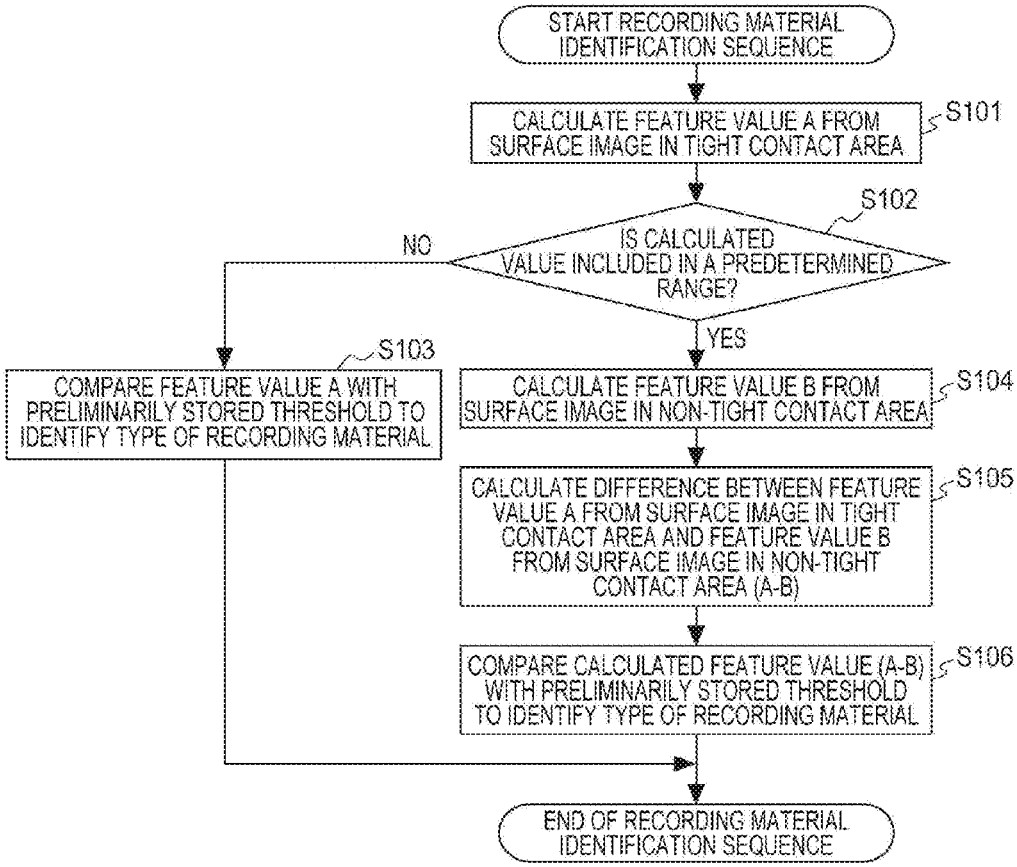
FIG. 5 is a flowchart showing a method of identifying the recording material.
Figure 6:
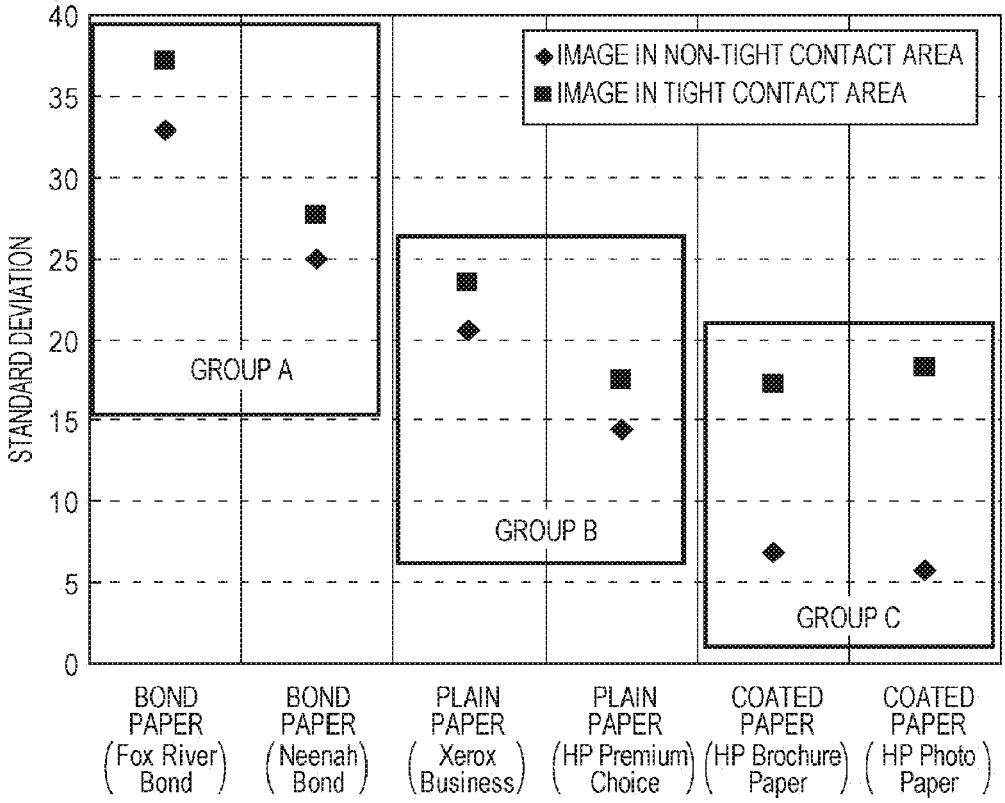
FIG. 6 is a graph showing feature values of recording materials.

Referring to FIGS. 5 and 6, the method of identifying the recording material P using a surface image picked up in the tight contact area and a surface image picked up in the non-tight-contact area will be described. FIG. 5 shows a flowchart of the method of identifying the recording material P. FIG. 6 shows a graph for distinguishing bond paper, plain paper, and coated paper using the output results of the surface images picked up in the tight contact area and in the non-tight-contact area. Herein, the recording materials P are classified into three groups A, B, and C, which correspond to bond paper, plain paper, and coated paper. Bond paper has a rough surface compared with plain paper, and, when illuminated with light, the contrast of the reflected light is high. Coated paper is surface-coated and is relatively smooth, and, when illuminated with light, the contrast of the reflected light is not so high. Plain paper has a surface roughness between bond paper and coated paper.

Referring to the flowchart in FIG. 5, the method of identifying the recording material P will be described. In step S101, the control unit 10 calculates a feature value A of the surface roughness using a surface image picked up in the tight contact area. The calculation is performed by generating a histogram from the brightness information of the surface image, which is regarded as the standard deviation of the brightness distribution. Assuming that the number of pixels needed in the direction of the sensor is dot_w, the number of pixels needed in the conveying direction is dot_h, the data of the pixels of a two-dimensional surface image used for identification is Dj[i] (i=0 to dot_w, j=0 to dot_h), and the average value of Dj[i] is DA, the standard deviation is: the square root of the sum of Dj[i]−DA squared, divided by the number.

FIG. 6 shows calculation results of the feature value A of the roughness of the surface image, corresponding to each type of the recording material P. The vertical axis represents the standard deviation, which is the feature value A, and the horizontal axis represents the representative sheet types (bond paper, plain paper, and coated paper). Because the output value of the feature value A is calculated on the basis of the conditions according to this embodiment, when the conditions are changed, the output value can also be changed by an appropriate re-calculation. The results obtained by using the surface image picked up in the tight contact area show that the output values of coated paper and plain paper are substantially the same. This is because the recording materials like coated paper, which have smooth surface properties, are adhered to the guide surface when pressed, and the picked-up image tends to be darker than the actual brightness of the recording material that represents its surface properties. In other words, it is difficult to accurately distinguish between coated paper and plain paper based on the feature value A of the surface image picked up in the tight contact area. On the other hand, in every recording material, the output value in the non-tight-contact area is low due to the influence of the conveyance variations or the like. However, with coated paper, the output value in the non-tight-contact area more reflects the actual surface properties, compared with the output value in the tight contact area.

In step S102, the control unit 10 determines to which group, in the graph in FIG. 6, the feature value A calculated based on the surface image picked up in the tight contact area applies. When the feature value A is from 0 to 20, it cannot be determined whether the recording material P applies to the group B to which plain paper belongs, or the group C to which coated paper belongs. Thus, first, whether or not the feature value A is greater than 20 is determined. When the feature value A is greater than 20, the recording material P can be identified based on the feature value A. Thus, in step S103, the control unit 10 identifies the type of the recording material P based on the feature value A. When the feature value A is smaller than 20, whether the recording material P is plain paper or coated paper cannot be determined. Thus, in step S104, the control unit 10 calculates a feature value B of the surface image picked up in the non-tight-contact area.

In step S103, the control unit 10 determines whether the recording material P is bond paper or plain paper, which can be determined based on the feature value A. Because the feature value A obtained from the surface image picked up in the tight contact area is a stable output value without the influence of conveyance fluttering, the type of the recording material P can be accurately identified. Based on the type of the recording material P identified, the image-forming conditions of the image forming apparatus are controlled.

In step S104, the control unit 10 calculates the feature value B of the surface roughness using the surface image picked up in the non-tight-contact area. The calculation is performed in the same way as the calculation of the feature value A.

In step S105, the control unit 10 calculates the difference between the feature value A calculated in step S101 and the feature value B calculated in step S104 (A−B). By calculating the difference between the feature value A and the feature value B, whether the output value of the feature value A indicates the recording material P with smooth surface properties or the recording material P with non-smooth surface properties is determined.

In step S106, the control unit 10 identifies the type of the recording material P based on the difference between the feature values (A−B). When the difference (A−B) is small, the recording material P is determined to be plain paper, because such a small difference between the output values of the surface images picked up in the tight contact area and in the non-tight-contact area is caused by conveyance fluttering. When the difference (A−B) is large, the recording material P is determined to be coated paper, because such a large difference between the output values of the surface images picked up in the tight contact area and in the non-tight-contact area is caused by the smooth recording material P being adhered to the reading surface, and by an image darker than the actual brightness that represents its surface properties being picked up. Although plain paper and coated paper are distinguished based on the difference between the feature values A and B (A−B), they may be distinguished based only on the feature value B. Because the feature value B obtained from coated paper tends to be lower than that obtained from plain paper, the recording material P can be identified according to the output distribution shown in FIG. 6. Based on the type of the recording material P identified, the image-forming conditions of the image forming apparatus are controlled.

As has been described, by making it possible to pick up surface images in the tight contact area and the non-tight-contact area using a single pressing member, the accuracy of identifying the recording material P is improved using surface images in the tight contact area and the non-tight-contact area.

Second Embodiment

In the first embodiment, the method of identifying the recording material utilizing a roller-shaped pressing member capable of forming a tight contact area and a non-tight-contact area has been described. In this embodiment, a configuration in which the tight contact area and the non-tight-contact area can be formed by improving the configuration of the image-pickup surface of an image-pickup unit will be described. Note that the same reference numerals refer to the same configurations as in the above-described first embodiment, and a description thereof will be omitted.

Figure 7A:
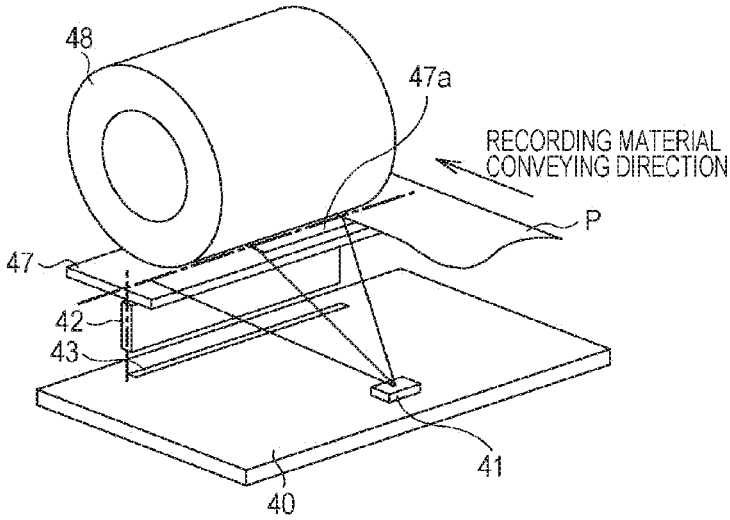
FIGS. 7A to 7C are a perspective view, a vertical cross-sectional view, and a horizontal cross-sectional view showing the configuration of a recording-material identifying apparatus according to a second embodiment.
Figure 7B:
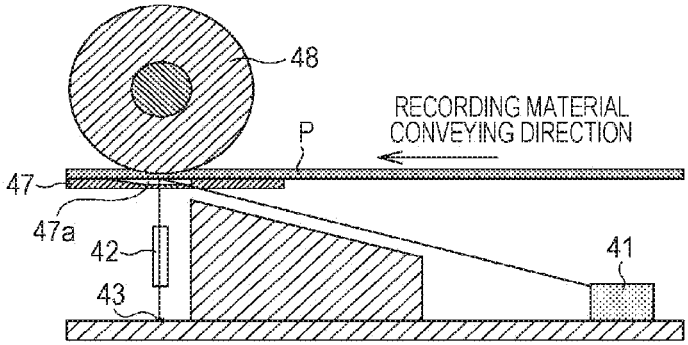
Figure 7C:
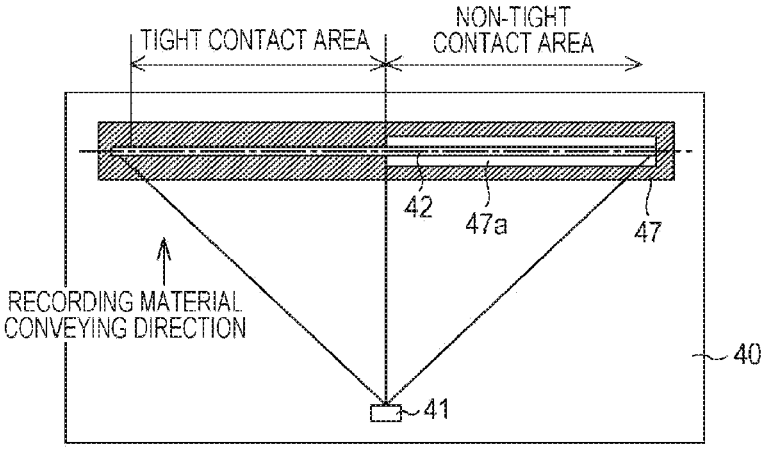

FIGS. 7A to 7C show the protection member 47 according to this embodiment. FIG. 7A shows the configuration of the recording-material identifying apparatus 40 configured to pick up a surface image representing the surface smoothness. FIG. 7B is a vertical cross-sectional view of FIG. 7A, and FIG. 7C is a horizontal cross-sectional view of FIG. 7A. Because the configuration except for the protection member 47 and the pressing member 48 is the same as that shown in FIGS. 2A to 2C, a detailed description thereof will be omitted.

As shown in FIG. 7, an illuminating area to the left of the optical axis of the illuminating LED 41 serves as the tight contact area, with which the recording material P is brought into tight contact, and an illuminating area to the right of the optical axis of the illuminating LED 41 serves as the non-tight-contact area, with which the recording material P is not brought into tight contact. In this embodiment, a groove 47*a* having a depth of 0.25 mm is provided in the image-pickup surface to form the tight contact area and the non-tight-contact area. The depth of the groove is not limited to 0.25 mm, as long as the tight contact area and the non-tight-contact area can be ensured. Furthermore, the right side and left side of the protection member 47 can be changed, as long as the tight contact area and the non-tight-contact area can be provided. Furthermore, the number of tight contact areas and the number of non-tight-contact areas are not limited to one each, and the tight contact areas and the non-tight-contact areas may be formed alternately. Similarly to the first embodiment, by picking up a surface image of the recording material P with the pressing member 48 and the protection member 47 capable of forming the tight contact area and the non-tight-contact area, the recording material P can be accurately identified.

Note that the pressing member 48 does not necessarily have to press the recording material P at both tight contact area and non-tight-contact area. For example, the tight contact area may serve as a pressing area where the recording material P is pressed, and the non-tight-contact area, in which the diameter of the pressing member 48 is small, may serve as a non-pressing area where the recording material P is not pressed. Furthermore, in the non-tight-contact area, the configuration of the pressing member 48 described in the first embodiment may be incorporated; the groove 47*a* may be provided in the protection member 47, and the diameter of the pressing member 48 may be reduced.

Because the groove is provided in the protection member 47, paper dust from the recording material P may deposit in the groove. To prevent paper dust from depositing, a gentle slope downward toward the CMOS line sensor 43 is formed in the protection member 47, from the upstream side toward the downstream side in the conveying direction of the recording material P, as shown in FIG. 7B. Thus, a function of conveying the recording material P and a function of conveying paper dust can be achieved simultaneously.

Third Embodiment

In the first embodiment, the configuration in which the tight contact area and the non-tight-contact area are formed by providing a step in the pressing member, in the rotation direction thereof, has been described. In this embodiment, a configuration in which the tight contact area and the non-tight-contact area are formed by providing a step in the pressing member, in the direction perpendicular to the rotation direction thereof, will be described. Note that the same reference numerals refer to the same configurations as in the above-described first embodiment, and a description thereof will be omitted.

Figure 8A:
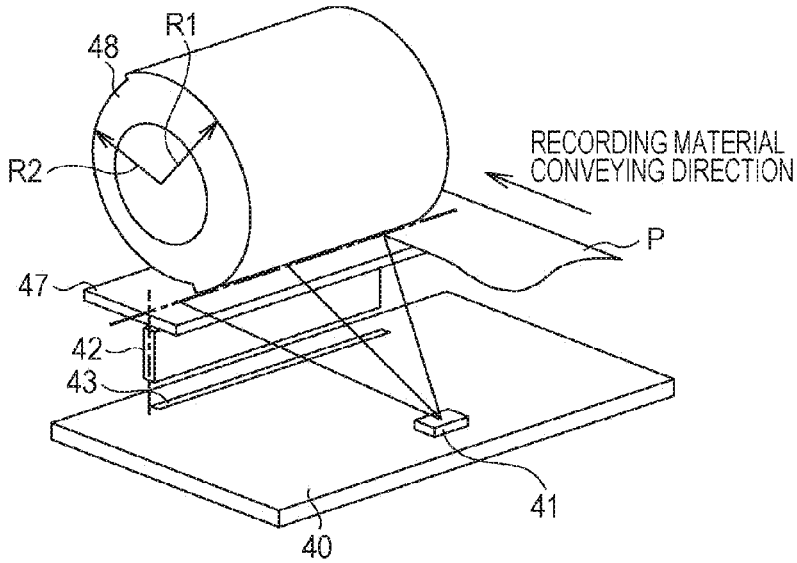
FIGS. 8A to 8C are a perspective view, a vertical cross-sectional view, and a horizontal cross-sectional view showing the configuration of a recording-material identifying apparatus according to a third embodiment.
Figure 8B:
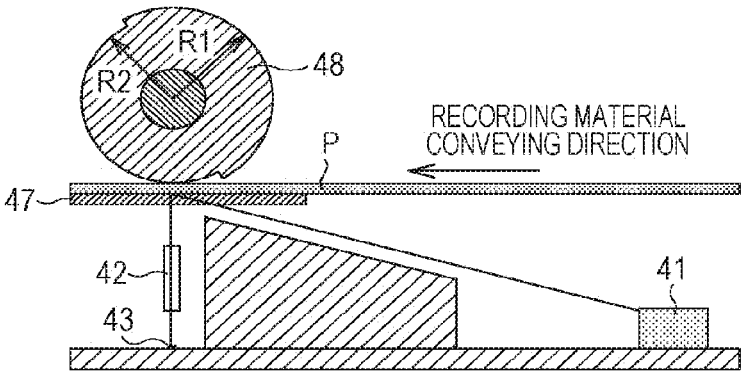
Figure 8C:
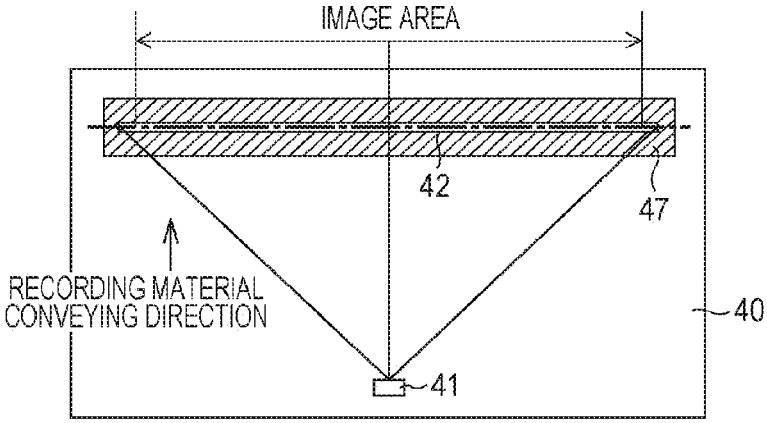

FIGS. 8A to 8C show the pressing member 48 according to this embodiment. FIG. 8A shows the configuration of the recording-material identifying apparatus 40 configured to pick up a surface image representing the surface smoothness. FIG. 8B is a vertical cross-sectional view of FIG. 8A, and FIG. 8C is a horizontal cross-sectional view of FIG. 8A. Because the configuration except for the shape of the pressing member 48 is the same as that shown in FIGS. 2A to 2C, a detailed description thereof will be omitted.

As shown in FIGS. 8A to 8C, the pressing member 48 is composed of a semicircle having a radius R1 and a semicircle having a radius R2, in the area corresponding to the reading position of the image-pickup unit. In this embodiment, R1 is 5 mm, and R2 is 4 mm. However, as long as surface images in the tight contact area and the non-tight-contact area can be picked up, the radii are not limited to these values. The part having the radius R1 is used to pick up a surface image in the tight contact area, with which the recording material P is brought into tight contact, and the part having the radius R2 is used to pick up a surface image in the non-tight-contact area, with which the recording material P is not brought into tight contact. By picking up the surface image while the thus-configured pressing member 48 makes one rotation, surface images in the tight contact area and the non-tight-contact area can be picked up. Although the configuration in which the part having the radius R1 and the part having the radius R2 switch positions with each other once while the pressing member 48 makes one rotation has been described as an example, as long as surface images in the tight contact area and the non-tight-contact area can be picked up, the part having the radius R1 and the part having the radius R2 may switch positions with each other more than once.

Figure 9:
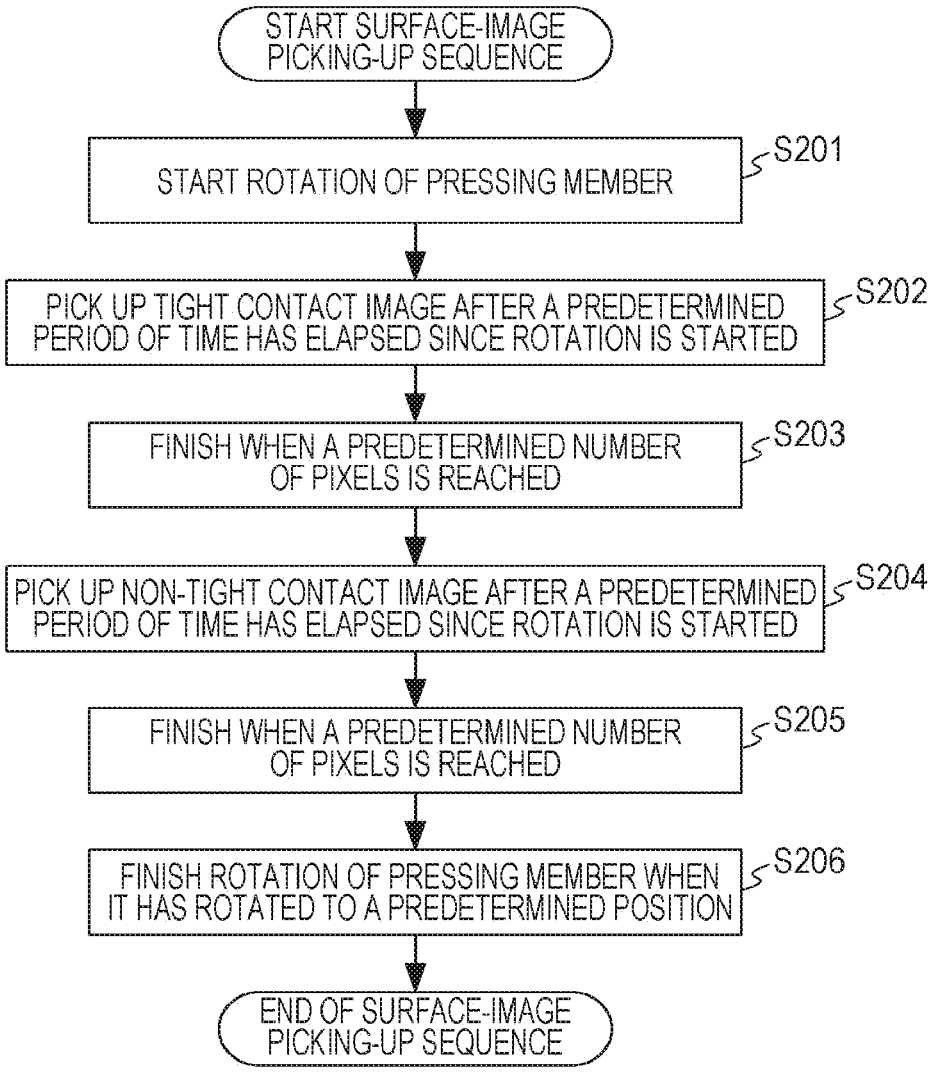
FIG. 9 is a flowchart showing a method of picking up images with the recording-material identifying apparatus according to the third embodiment.

Referring to the flowchart in FIG. 9, a method of picking up surface images of the recording material P will be described. In step S201, the control unit 10 causes the pressing member 48 to start rotation. In step S202, the control unit 10 performs picking up of a surface image in the tight contact area, after a predetermined period of time has elapsed since the pressing member 48 started rotating. The "predetermined period of time" is a period of time needed for the pressing member 48 to form a stable tight contact area, and, in this embodiment, the pressing member 48 starts to rotate clockwise from the position shown in FIG. 8B and picking up of a surface image in the tight contact area is started when it has rotated by 60 degrees. The timing of picking up the surface image is not limited to when the pressing member 48 has rotated by 60 degrees, and the timing may be appropriately set, as long as the surface image in the tight contact area can be picked up.

In step S203, the control unit 10 performs picking up of the surface image until a predetermined number of pixels needed in the conveying direction is reached. Although the number of pixels needed is 118 pixels in this embodiment, the number of pixels needed for identifying the recording material P is not limited thereto. In step S204, the control unit 10 performs picking up of a surface image in the non-tight-contact area, after a predetermined period of time has elapsed since the pressing member 48 started rotating. The "predetermined period of time" is a period of time needed for the pressing member 48 to form a stable non-tight-contact area, and, in this embodiment, the pressing member 48 starts to rotate clockwise from the position shown in FIG. 8B and picking up of a surface image in the non-tight-contact area is started when it has rotated by 240 degrees. The timing of picking up the surface image is not limited to when the pressing member 48 has rotated by 240 degrees, and the timing may be appropriately set, as long as the surface image in the non-tight-contact area can be picked up.

In step S205, the control unit 10 performs picking up of the surface image until a predetermined number of pixels needed in the conveying direction is reached. Although the number of pixels needed is 118 pixels in this embodiment, the number of pixels needed for identifying the recording material P is not limited thereto. In step S206, when the surface images in the tight contact area and the non-tight-contact area have been picked up, the control unit 10 causes the pressing member 48 to stop rotation at the position shown in FIG. 8B.

In this manner, by controlling the rotation of the pressing member 48, surface images in the tight contact area and the non-tight-contact area can be picked up. By performing the method of identifying the recording material P, described with reference to the flowchart in FIG. 5, based on the respective surface images, the recording material P can be identified. Accordingly, surface images in the tight contact area and the non-tight-contact area can be alternately picked up by using a single pressing member, utilizing the entire image area in the rotation direction of the pressing member. Thus, the accuracy of identifying the recording material P is improved using the surface images in the tight contact area and the non-tight-contact area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-242461 filed Oct. 28, 2010, and Japanese Patent Application No. 2011-194964 filed Sep. 7, 2011, both of which are hereby incorporated by reference herein in their entirety.

What is claimed is:

1. A recording-material identifying apparatus comprising:

an illuminating unit configured to illuminate a recording material with light;

a pressing member configured to press the recording material to form, in the recording material, a first pressing area and a second pressing area, a pressing force in the second pressing area being smaller than that in the first pressing area;

an image-pickup unit configured to pick up light reflected by a surface of the recording material that is illuminated by the illuminating unit and is pressed by the pressing member as images of the recording material; and a control unit configured to identify the type of the recording material based on the images in the first pressing area and the second pressing area that are picked up by the image-pickup unit.

2. The recording-material identifying apparatus according to claim 1, further comprising a protection member configured to protect the image-pickup unit, wherein the protection member is provided so as to face the pressing member and forms the first pressing area and the second pressing area by forming a nip with respect to the pressing member.

3. The recording-material identifying apparatus according to claim 1, wherein the pressing member is a roller for conveying the recording material, the roller being composed of a portion having a first radius, which forms the first pressing area, and a portion having a second radius smaller than the first radius, which forms the second pressing area.

4. The recording-material identifying apparatus according to claim 1, wherein the image-pickup unit simultaneously picks up the images in the first pressing area and the second pressing area.

5. A recording-material identifying apparatus comprising:

an illuminating unit configured to illuminate a recording material with light;

a pressing member configured to form a pressing area where the recording material is pressed and a non-pressing area where the recording material is not pressed;

an image-pickup unit configured to pick up light reflected by a surface of the recording material that is illuminated by the illuminating unit and is pressed by the pressing member as images of the recording material; and a control unit configured to identify the type of the recording material based on the images in the pressing area and the non-pressing area that are picked up by the image-pickup unit.

6. The recording-material identifying apparatus according to claim 5, further comprising a protection member configured to protect the image-pickup unit, wherein the protection member is provided so as to face the pressing member and forms the pressing area and the non-pressing area by forming a nip with respect to the pressing member.

7. The recording-material identifying apparatus according to claim 5, wherein the pressing member is a roller for conveying the recording material, the roller being composed of a portion having a first radius, which forms the pressing area, and a portion having a second radius smaller than the first radius, which forms the non-pressing area.

8. The recording-material identifying apparatus according to claim 5, wherein the image-pickup unit simultaneously picks up the images in the pressing area and the non-pressing area.

9. A recording-material identifying apparatus comprising:

an illuminating unit configured to illuminate a recording material with light;

a pressing member configured to press the recording material;

an image-pickup unit configured to pick up light reflected by a surface of the recording material that is illuminated by the illuminating unit and is pressed by the pressing member as images of the recording material;

a protection member provided so as to face the pressing member and configured to protect the image-pickup unit; and a control unit configured to identify the type of the recording material based on the images picked up by the image-pickup unit;

wherein the pressing member and the protection member form a nip portion at which the recording material is nipped, thereby forming a first pressing area and a second pressing area, in which the recording material is pressed, a pressing force in the second pressing area being smaller than that in the first pressing area, and wherein the control unit identifies the type of the recording material based on the images in the first pressing area and the second pressing area that are picked up by the image-pickup unit.

10. A recording-material identifying apparatus comprising:

an illuminating unit configured to illuminate a recording material with light;

a pressing member configured to press the recording material;

an image-pickup unit configured to pick up light reflected by a surface of the recording material that is illuminated by the illuminating unit and is pressed by the pressing member as images of the recording material;

a protection member provided so as to face the pressing member and configured to protect the image-pickup unit; and a control unit configured to identify the type of the recording material based on the images picked up by the image-pickup unit;

wherein the pressing member and the protection member form a nip portion at which the recording material is nipped, thereby forming a pressing area where the recording material is pressed and a non-pressing area where the recording material is not pressed, and wherein the control unit identifies the type of the recording material based on the images in the pressing area and the non-pressing area that are picked up by the image-pickup unit.

11. An image forming apparatus comprising:

an image forming unit configured to form an image on a recording material;

an illuminating unit configured to illuminate a recording material with light;

a pressing member configured to press the recording material to form, in the recording material, a first pressing area and a second pressing area, a pressing force in the second pressing area being smaller than that in the first pressing area;

an image-pickup unit configured to pick up light reflected by a surface of the recording material that is illuminated by the illuminating unit and is pressed by the pressing member as images of the recording material; and a control unit configured to control image-forming conditions of the image forming unit based on the images in the first pressing area and the second pressing area that are picked up by the image-pickup unit.

12. An image forming apparatus comprising:

an image forming unit configured to form an image on a recording material;

an illuminating unit configured to illuminate a recording material with light;

a pressing member configured to form a pressing area where the recording material is pressed and a non-pressing area where the recording material is not pressed;

an image-pickup unit configured to pick up light reflected by a surface of the recording material that is illuminated by the illuminating unit and is pressed by the pressing member as images of the recording material; and a control unit configured to control image-forming conditions of the image forming unit based on the images in the pressing area and the non-pressing area that are picked up by the image-pickup unit.

13. An image forming apparatus comprising:

an image forming unit configured to form an image on a recording material;

an illuminating unit configured to illuminate a recording material with light;

a pressing member configured to press the recording material;

an image-pickup unit configured to pick up light reflected by a surface of the recording material that is illuminated by the illuminating unit and is pressed by the pressing member as surface images of the recording material;

a protection member provided so as to face the pressing member and configured to protect the image-pickup unit; and a control unit configured to control image-forming conditions of the image forming unit;

wherein the pressing member and the protection member form a nip portion at which the recording material is nipped, thereby forming a first pressing area and a second pressing area, in which the recording material is pressed, a pressing force in the second pressing area being smaller than that in the first pressing area, and wherein the control unit controls the image-forming conditions of the image forming unit based on the images in the first pressing area and the second pressing area that are picked up by the image-pickup unit.

14. An image forming apparatus comprising:

an image forming unit configured to form an image on a recording material;

an illuminating unit configured to illuminate a recording material with light;

a pressing member configured to press the recording material;

an image-pickup unit configured to pick up light reflected by a surface of the recording material that is illuminated by the illuminating unit and is pressed by the pressing member as images of the recording material;

a protection member provided so as to face the pressing member and configured to protect the image-pickup unit; and a control unit configured to control image-forming conditions of the image forming unit;

wherein the pressing member and the protection member form a nip portion at which the recording material is nipped, thereby forming a pressing area where the recording material is pressed and a non-pressing area where the recording material is not pressed, and wherein the control unit controls the image-forming conditions of the image forming unit based on the images in the pressing area and the non-pressing area that are picked up by the image-pickup unit.

* * * * *